United States Patent [19]

Sandling

[11] Patent Number: 4,843,761

[45] Date of Patent: Jul. 4, 1989

[54] ARRANGEMENT IN REVOLVING DOOR ASSEMBLIES

[75] Inventor: Kjell H. Sandling, Helsingborg, Sweden

[73] Assignee: Besam Aktiebolag, Landskrona, Sweden

[21] Appl. No.: 204,461

[22] Filed: Jun. 9, 1988

[30] Foreign Application Priority Data

Jun. 18, 1987 [SE] Sweden ..... 8702558

[51] Int. Cl.[4] ..... E06B 3/34

[52] U.S. Cl. ..... 49/41; 49/44; 109/68; 109/71

[58] Field of Search ..... 49/41, 42, 68, 44, 45; 109/6, 7, 8, 70, 71, 68

[56] References Cited

U.S. PATENT DOCUMENTS 798,786 9/1905 Hansen .

4,557,073 12/1985 Sandling ..... 49/41

FOREIGN PATENT DOCUMENTS 1223699 3/1971 United Kingdom .

160737 2/1903 Fed. Rep. of Germany .

254103 5/1911 Fed. Rep. of Germany .

*Primary Examiner*—Kenneth J. Dorner

*Assistant Examiner*—Gerald A. Anderson

*Attorney, Agent, or Firm*—Jordan and Hamburg

[57] ABSTRACT

A revolving door assembly includes a pair of part-cylindrical wall portions partly surrounding the rotational path of a revolving door and partly defining a passage. Pairs of part-cylindrical wall panels are provided in association with the part-cylindrical wall portions, such wall panels being movable along paths concentric with the rotational path of the revolving door and being adapted to close and open the passage substantially in syncronism with the continuous rotation of the revolving door. Thereby passage will remain checked during such rotation, alternatingly by the revolving door alone and by the door in cooperation with the wall panels of each pair, whereby a draft-free passage will be maintained.

9 Claims, 2 Drawing Sheets

ARRANGEMENT IN REVOLVING DOOR ASSEMBLIES

The present invention relates to an arrangement in revolving door assemblies, wherein a revolving door cooperates with reciprocating wall panels in such a way that a draught-free passage is maintained even when the revolving door has its outer ends situated in the area of the passage.

A revolving door assembly comprising a pair of part-cylindrical wall portions defining a passage and partly surrounding the rotational path or orbit of a revolving door of the double-wing type is previously known from e.g. U.S. Pat. No. 4,557,073. In order to attain a draught-free atmosphere in the passage through the said revolving door assembly the revolving door is provided at its outer ends with curved portions, which rotate with the door and which have such a length that they cover the complete opening during a portion of their rotation. This known revolving door assembly has the inconvenience that the passage opening cannot be made as wide as desired, as that would mean that too long curved portions have to be provided. Furthermore, the portions rotate within the space where persons are dwelling, which can be detrimental from the point of safety.

By the present invention the inconveniences mentioned above are eliminated, at the same time as a revolving door assembly with a revolving door of the double-wing type is provided, whose passage is free from undesired draught and whose access opening can be made wider than before, whereby passage though the revolving door assembly is facilitated. A revolving door of the double-wing type has the advantage over such doors having three, alternatively four wings that it provides a larger free passage between the part-cylindrical wall portions and the revolving door itself.

According to the invention an arrangement in revolving door assemblies is thus provided comprising, on the one hand, a pair of stationary part-cylindrical wall sections which partly surround the rotational path of a revolving door and partly define a passage and, on the other hand, pairs of part-cylindrical wall panels provided in association with the part-cylindrical wall sections. The invention has the characteristic features that the part-cylindrical wall panels are movable along paths concentric with the said rotational path of the revolving door and arranged to close and open the passage substantially in syncronism with the continuous rotation of the revolving door, so that passage during said rotation remains checked, alternatingly by the revolving door alone and by said door together with wall panels of either pair, one wall panel of each pair being adapted to describe a movement in co-rotation with the revolving door across a first portion of the passage at the same time as a second wall panel of each pair is adapted to describe a movement in counter-rotation with the revolving door across a second portion of the passage, after which said wall panels change their direction of travel so that they return to their starting positions at the same time as the revolving door completes its rotating movement, whereby a draught-free passage is maintained.

These and other characteristic features are disclosed in the accompanying patent claims. The invention will be described in greater details with reference to the accompanying drawings which exemplify an embodiment in a digrammatic way.

DESCRIPTION OF THE PREFERRED EMBODIMENTS

Figure 1:
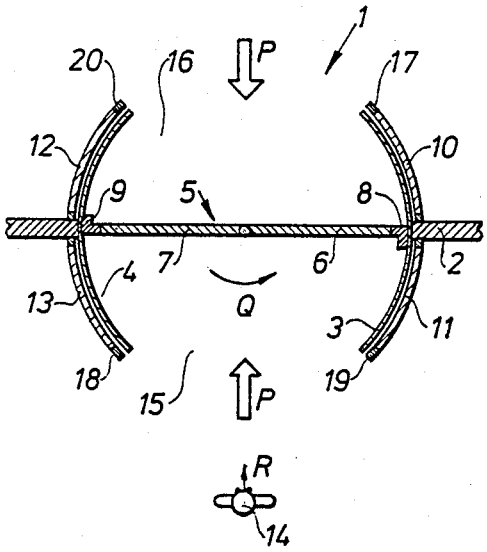
FIG. 1 shows a cross-sectional top view of a revolving door assembly in a position before rotation is initiated.

In FIG. 1 a revolving door assembly 1 is shown in a starting position wherein passage P is allowed in either direction, for example, into and out from a building 2. The revolving door assembly includes two stationary part-cylindrical wall sections 3, 4. In the space between said part-cylindrical wall sections 3, 4 a revolving door 5 is rotatably suspended in a manner not shown in detail. The revolving door is of the double-wing type, that is to say it comprises two wings or leaves 6, 7 which are diametrically arranged in a common vertical plane. The outer ends 8, 9 of the wings 6, 7 terminate adjacent the part-cylindrical wall portions 3, 4 so that the revolving door 5, in the position shown in FIG. 1, closes completely the passage between wall sections 3, 4. Outside each of the wall sections and coaxially arranged in relation thereto there are pairs of part-cylindrical wall panels 10, 11 and 12, 13 respectively. One wall panel pair 10, 11 is located in association with the wall section 3, another pair 12, 13 in association with wall section 4. The wall panels 10–13 are movable along paths concentric with the rotational path or orbit of the revolving door in a manner which will be described below with reference to FIGS. 1–5. In the starting position the revolving door 5 is oriented substantially crosswise of the passage, whereas the wall panels 10–13 are assuming their "open" position.

Figure 2:
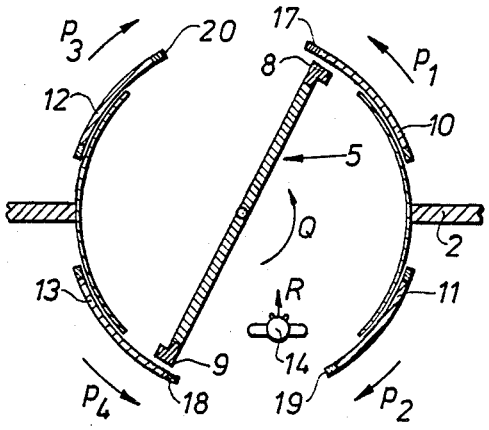
FIGS. 2–5 are similar views of the revolving door assembly according to FIG. 1 in various positions of rotation.

A person 14 who is to pass the revolving door assembly in direction R approaches the opening 15 defined between the part-cylindrical wall sections 3, 4 the opening forming the entrance to the passage. A detector or similar sensing means (not shown) is associated with opening 15 and detects the approaching person. The detector initiates a starting pulse for a number of drive motors which operate separately and in syncronism the revolving door 5 and the part-cylindrical wall panels 10–13. When the revolving door 5 now starts to rotate in the direction of arrow Q, the two part-cylindrical wall panels 10 and 13 will follow the revolving door in its rotation with their leading ends 17 and 18 closely related to the outer ends 8 and 9, respectively, of the revolving door, as shown in FIG. 2 by arrows $p_1$ and $p_4$. At the same time the two remaining wall panels 11 and 12 will travel such that their rear ends 19, 20 move in a direction opposite the direction of rotation of the revolving door, as shown by arrows $p_2$ and $p_3$. In the position shown in FIG. 3 the revolving door has turned so far that the door is parallel to the direction of "flow" through the revolving door assembly. In this position the leading end 17 of wall panel 10 and the rear end 20 of wall panel 12 have met adjacent the outer end 8 of the revolving door, at the same time as the leading end 18 of wall panel 13 and the rear end 19 of wall panel 11 have met adjacent the opposite outer end 9 of the revolving door. In this position passage through the revolving door assembly is completely blocked. During the continued rotation of the revolving door 5 in the direction of arrow Q, see FIG. 4, the movements of the cylindrical wall panels are reversed, so that the two wall panels 11, 12 with their rear ends 19, 20 closely associated with the outer ends 8, 9 of the revolving door, join the rotation of the revolving door in the same direction, at the same time as the two remaining wall panels 10 and 13 with their leading ends 17 and 18 move in a direction opposite that of the rotation of the revolving door as shown by arrows $q_1$, $q_2$, $q_3$, $q_4$, until the revolving door has passed openings 15, 16 with its outer ends. Thereby the wall panels have returned to their starting positions, see FIG. 5, whereas the revolving door is allowed to continue its rotating movement with its outer ends contiguous to the par-cylindrical wall sections 3, 4, until the revolving door has assumed again the starting position shown in FIG. 1. The door is now ready for a new cycle of rotation as soon as the detector senses a new object approaching the passage. As a matter of course there are similar detectors provided in connection with the opposite opening 16, and the procedure here will correspond to the sequence of rotation described above.

Figure 3:
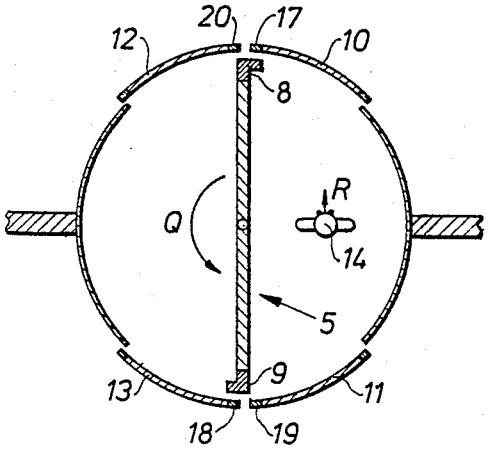
Figure 4:
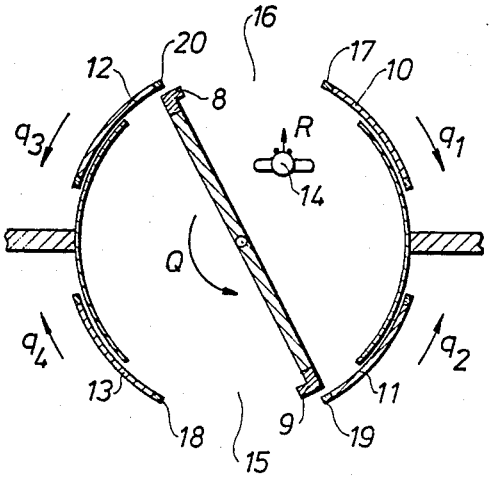
Figure 5:
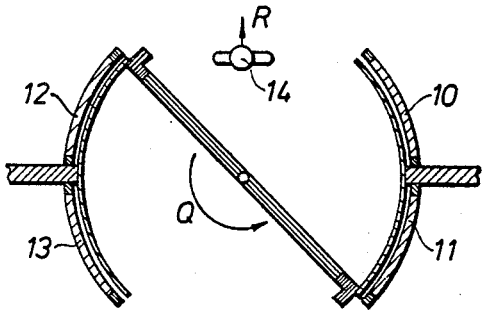

The arrangement according to the invention has the specific feature that opening is initiated centrally from the closed position as shown in FIG. 3. This has not been possible before in revolving doors. In order to attain a faster opening process, wall panels 10 and 13 can be allowed to travel at a higher speed during their counter-rotation (see FIG. 4) than the other wall panels. Thereby a more rapid opening of the passage is attained.

It should be pointed out that the end portions 17–20 of the wall panels 10–13 have been denoted, strictly for the purpose of definition, leading ends and rear ends, respectively, meaning, that leading ends are those ends 17, 18 which are situated, during the movement of wall panels 10, 13 together with revolving door 5 (FIG. 2), in close relation to the outer ends 8, 9 of the revolving door and have their associated panels following behind. On the other hand, those ends 19, 20 are named rear ends which, during the travel of wall panels 11, 12 together with revolving door 5 (FIG. 4), lie in close relation to the outer ends 8, 9 of the revolving door and have their associated panels moving ahead.

In order to eliminate the risk of pinching in the revolving door according to the invention the leading ends of wall panels 10, 13 are arranged movable in a position somewhat ahead, as viewed in the direction of rotation, of the outer ends of the revolving door, as shown in FIG. 2. When the wall panel, which is of light weight compared with the revolving door, makes contact by its leading end with an object the wall panels are reversed at the same time as the movement of the revolving door is retarded, and at a lower speed the door will move to a position in parallel with the though-flow direction, where it stops. When it has been established that no object blocks the way any longer, the wall panels 10–13 are again allowed to close, after which the revolving door rotates to its starting position and the wall panels are opened once more, so that the position shown in FIG. 1 is assumed.

Furthermore, as the wall panels and the revolving door are preferably driven by separate motors it is possible to disengage and free the wall panels and arrange the revolving door in a stationary position in parallel with the passage through the revolving door assembly. Thereby the flow through the passage can be increased at high traffic load. With the revolving door assuming this position, it is also possible to let the wall panels move to and fro in their paths whereby a sliding door effect is obtained. Here it is also conceivable to open and close the wall panels alternatingly, for example, such that wall panels 11 and 10 move independently of wall panels 12 and 13. Thereby a door assembly can be created which has separated entrance and exit paths. Alternatively wall panels 10 and 11 can move as one unit and wall panels 12 and 13 as another, whereby one passage may be kept closed while the other passage is open.

In a night position the wall panels can cover the passage at the same time as the revolving door is put in a position crosswise of the passage direction.

Figure 6:
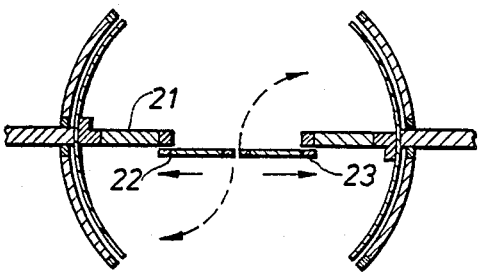
FIG. 6 shows alternative embodiments of the revolving door assembly.
Figure 7:
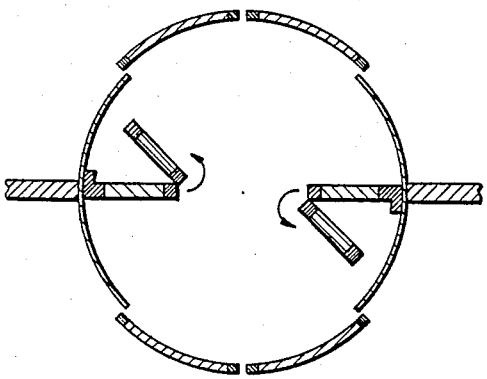
FIGS. 7–8 illustrate the embodiments of FIG. 6 arranged as conventional perchs.
Figure 8:
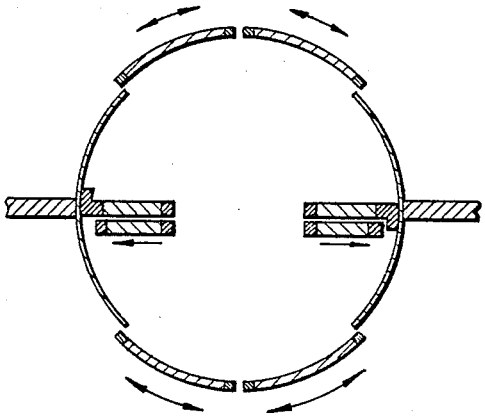

In FIG. 6 there is shown an alternative embodiment of the revolving door assembly according to the invention. In this case the central portion of the revolving door 21 has been provided with sliding doors or, alternatively, hinge-type doors 22, 23, which can be arranged to open automatically at heavy traffic and/or in an emergency. By keeping the sliding doors open at the same time as the wall panels are left closed a conventional perch structure is obtained, see FIGS. 7 and 8.

The invention is not to be considered limited to the embodiments exemplified and explained above but several modifications are conceivable within the scope of the following patent claims.

I claim:

1. A revolving door assembly comprising a revolving door rotatable about a longitudinal axis, a stationary structure having a pair of stationary wall sections each having a partial cylindrical configuration, said wall sections being diametrically spaced from one another to define a passage therebetween, said revolving door having outer radial end parts which transcribe a circular path as said revolving door revolves, said wall sections being juxtaposed to said circular path, wall panels each having a partial circular configuration, said wall panels being movably mounted on said stationary structure for movement along a circular path between a closed position and an open position with the center of the last said circular path being coincident with said longitudinal axis, said wall panels in said closed position closing off said passage, said wall panels in said open position being removed from at least parts of said passage to preclude closing-off of said passage, said wall panels being movable between said open and closed positions in synchronism with the rotation of said revolving door as said movable wall panels and said revolving door alternatively open and close-off said passage to provide a draft-free passage as people pass through the revolving door.

2. A revolving door assembly according to claim 1, wherein there is a first pair of said wall panels which overlap with a first one of said wall sections when in said open position and a second pair of said wall panels which overlap with a second one of said wall sections when in said open position, one of said wall panels of said first pair and one of said wall panels of said second pair rotating in one direction when moving between said open and closed positions, the other of said wall panels of said first pair and the other of said wall panels of said second pair simultaneous rotating in an opposite direction.

3. A revolving door assembly according to claim 2, wherein said one of said wall panels of said first pair is designated a first wall panel and said other of said wall panels of said first pair is designated a second wall panel, and further wherein said one of said wall panels of said second pair is designated a third wall panel and said other of said wall panels of said second pair is designated a fourth wall panel, said first and third wall panels being diametrically opposed to one another, said second and fourth wall panels being diametrically opposed to one another, said first and third wall panels rotating in said one direction as said second and fourth wall panels simultaneously rotate in an opposite direction.

4. A revolving door assembly according to claim 3, wherein each of said wall sections have one end portion spaced from one another to define a first passage space and each of said wall sections have another end portion spaced from one another to define a second passage space, said first and fourth wall panels when in said closed position closing off said first passage space, said second and third wall panels when in said closed position closing off said second passage space.

5. A revolving door assembly according to claim 4, wherein said first and second passage spaces each having a mid-point midway between the respective spaced end portions, said passage having a passage axis passing through said mid-points and also intersecting said longitudinal axis, said revolving door comprising a generally planar door wall having a center coincident with said longitudinal axis, said planar door wall being parallel to said passage axis when said wall panels are in said closed position, said planar door wall being perpendicular to said planar passage axis when said wall panels are in said open position.

6. A revolving door assembly according to claim 1, wherein said wall panels each have a leading edge portion, said outer radial end parts of said revolving door being juxtaposed to respective leading edge portions of said wall panels during at least part of the time that the wall panels are moving between said open and closed position.

7. A revolving door assembly according to claim 6, wherein said leading edge portions extend at least partially forward of the respective radial end parts of said revolving door in the direction of rotation of the revolving door when said wall panels are moving from said open to said closed position.

8. A revolving door assembly according to claim 1, wherein said wall panels when in said closed position are disposed generally radially outwardly from said wall sections.

9. A revolving door assembly according to claim 1, wherein said pair of stationary wall sections are disposed diametrically opposite one another.

* * * * *